US007608031B2

(12) United States Patent
Kerry

(10) Patent No.: US 7,608,031 B2
(45) **Date of Patent: *Oct. 27, 2009**

(54) ABDOMINAL EXERCISE DEVICE FOR INVERTED ABDOMINAL EXERCISES

(75) Inventor: Ken Kerry, Santa Ana, CA (US)

(73) Assignee: Kerrymagyari LLC, Santa Ana, CA (US)

( * ) Notice: Subject to any disclaimer, the term of this patent is extended or adjusted under 35 U.S.C. 154(b) by 257 days.

This patent is subject to a terminal disclaimer.

(21) Appl. No.: 11/510,680

(22) Filed: Aug. 25, 2006

(65) Prior Publication Data

US 2007/0161475 A1 Jul. 12, 2007

Related U.S. Application Data

(63) Continuation-in-part of application No. 10/876,227, filed on Jun. 24, 2004, now Pat. No. 7,121,989, which is a continuation-in-part of application No. 10/090,079, filed on Mar. 1, 2002, now abandoned.

(51) Int. Cl.
*A63B 26/00* (2006.01)

(52) U.S. Cl. ..... 482/142; 482/140

(58) Field of Classification Search ..... 482/140, 482/100, 137, 142, 66, 69, 62, 51; 446/227, 446/491

See application file for complete search history.

(56) References Cited

U.S. PATENT DOCUMENTS 743,914 A 11/1903 McMurran
1,582,487 A 4/1926 Shank
1,909,461 A * 5/1933 Costa ..... 473/443
2,713,609 A 7/1955 Niklason ..... 178/6
2,928,674 A 3/1960 Nawara ..... 272/58
3,285,070 A * 11/1966 McDonough ..... 73/379.01
3,399,888 A 9/1968 Jensen ..... 272/81
3,455,295 A 7/1969 Kellogg ..... 128/25
3,612,042 A 10/1971 Fry ..... 127/25
3,904,195 A 9/1975 Chavanne ..... 272/58
3,978,610 A 9/1976 Stubbman ..... 46/32
4,449,321 A 5/1984 Reiling ..... 46/113
4,519,605 A 5/1985 Leland ..... 272/116
4,627,588 A 12/1986 Block ..... 248/163.2
4,634,118 A 1/1987 Jensen ..... 272/117
4,686,727 A 8/1987 Wilkinson ..... 5/503
5,031,605 A 7/1991 Mills ..... 128/68
5,050,871 A 9/1991 Douglas et al. ..... 272/128
5,197,933 A 3/1993 Waters ..... 482/101
5,316,535 A 5/1994 Bradbury ..... 482/135
5,441,255 A 8/1995 Verbick ..... 273/26
5,518,479 A * 5/1996 Young et al. ..... 482/121
5,662,591 A 9/1997 Peindl et al. ..... 601/24
5,772,563 A 6/1998 Lin ..... 482/140

(Continued)

*Primary Examiner*—Lori Amerson
(74) *Attorney, Agent, or Firm*—Cislo & Thomas, LLP

(57) ABSTRACT

An exercise device allowing a user to exercise his abdominal region by lying on his back while extending his arms generally upwards is disclosed. The device has a hand-gripping member positioned generally above the user's head for the user to grip while exercising. The hand-gripping member allows for a wide range of motion which may include side-to-side, front-to-back, diagonal, and/or rotational motion. This enables the user can exercise his abdominal region by moving in a variety of different directions, while keeping his arms extended.

21 Claims, 15 Drawing Sheets

U.S. PATENT DOCUMENTS

| | | | | |
|---|---|---|---|---|
| 5,779,607 | A | 7/1998 | Harris | 482/140 |
| 5,853,357 | A | 12/1998 | Jones, Jr. | 482/140 |
| 5,882,284 | A | 3/1999 | Cayne | 482/130 |
| 5,931,768 | A | 8/1999 | Amesquita | 482/140 |
| 5,941,806 | A | 8/1999 | Olshansky et al. | 482/140 |
| 5,997,450 | A | 12/1999 | Wilkinson | 482/140 |
| 6,027,433 | A | 2/2000 | Flynn | 482/98 |
| 6,086,521 | A | 7/2000 | Solland | 482/140 |
| 6,090,020 | A | 7/2000 | Webber | 482/100 |
| 6,117,057 | A | 9/2000 | Olshansky et al. | 482/140 |
| 6,196,954 | B1 | 3/2001 | Chen | 482/131 |
| 6,244,991 | B1 | 6/2001 | Bingham | 482/69 |
| 6,338,700 | B1 | 1/2002 | Pollock | 482/95 |
| 6,443,877 | B1 * | 9/2002 | Hoecht et al. | 482/103 |
| 6,491,611 | B1 | 12/2002 | Stearns | 482/142 |
| 6,547,701 | B1 * | 4/2003 | Eschenbach | 482/57 |
| 6,739,096 | B2 | 5/2004 | Feldpausch et al. | 52/36.1 |
| 6,742,749 | B2 | 6/2004 | Kassai et al. | 248/163.2 |
| 6,743,152 | B2 | 6/2004 | Weiss | 482/38 |
| 7,063,651 | B2 * | 6/2006 | Kerry | 482/140 |
| 2002/0147087 | A1 | 10/2002 | Tollner | 482/147 |
| 2004/0157711 | A1 | 8/2004 | Regev | 482/142 |
| 2004/0198572 | A1 | 10/2004 | Rouillard | 482/142 |
| 2005/0079957 | A1 | 4/2005 | Bowman | 482/51 |

* cited by examiner

ABDOMINAL EXERCISE DEVICE FOR INVERTED ABDOMINAL EXERCISES

CROSS-REFERENCES TO RELATED APPLICATIONS

This application is a continuation-in-part of U.S. patent application Ser. No. 10/876,227, filed on Jun. 24, 2004 now U.S. Pat. No. 7,121,989, which is a continuation-in-part of U.S. patent application Ser. No. 10/090,079, filed on Mar. 1, 2002, and now abandoned, both of which are incorporated here by this reference.

BACKGROUND

Field of the Invention

This invention relates generally to an abdominal exercise device and more particularly to an abdominal exercise device that utilizes one or more sliding and pivoting motions for the purpose of exercising the abdominal muscles.

Various exercising equipment and equipment free methods of exercising have been developed for exercising the abdominal muscles. Abdominal muscles are generally difficult to isolate and strengthen. Many hours and years of exercise are generally necessary to produce a significant effect on the abdominal musculature. Exercising these muscles may create strain and pressure on the back and neck muscles, depending on the technique used. Additionally, failure to maintain consistent and proper alignment while exercising the abdominal muscles may result an ineffective workout as well as injury.

SUMMARY

An exercise device according to the present invention allows a user to exercise his abdominal region by lying on his back while extending the arms away from the body. The device has a hand-gripping member positioned generally above the user's head which the user grips while exercising. The force which the user exerts on the gripping element reduces the strain and pressure on the user's neck and back muscles, thus providing an isolated work out for mainly the abdominal muscles. The hand-gripping member allows for a wide range of motion which may include side-to-side, front-to-back, diagonal, and/or rotational motion. As such the user can exercise his abdominal region by moving in a variety of different directions, while keeping his arms extended. The device additionally provides the user with a technique of achieving proper and consistent alignment for achieving maximum results.

DESCRIPTION

Figure 1:
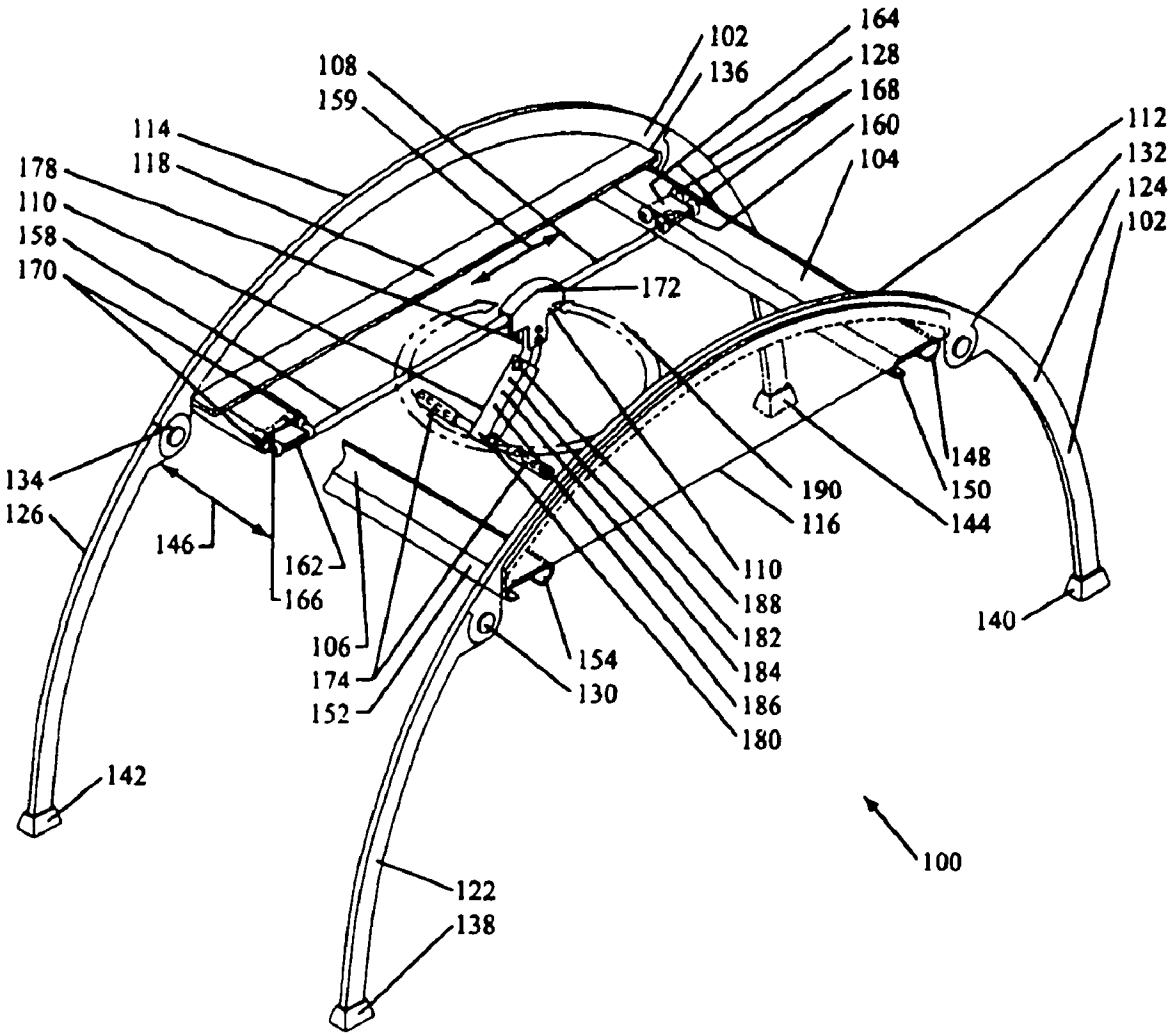
FIG. 1 is a perspective view of an abdominal exercise device according to a first embodiment of the present invention.

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, the same or equivalent functions and sequences may be accomplished by different embodiments that are also intended to be within the spirit and scope of the invention.

An exercise device according to the present invention allows a user to exercise his abdominal region by lying on his back while extending his arms generally upwards. The device has a hand-gripping member positioned generally above the user's head for the user to grip while exercising. The hand-gripping member allows for a wide range of motion which may include side-to-side, front-to-back, diagonal, and/or rotational motion. As such the user can exercise his abdominal region by moving in a variety of different directions, while keeping his arms extended.

FIGS. 1-4 illustrate an exercise device 100, for generally working the abdominal region, according to a first embodiment. The device 100 generally comprises a frame 102, first and second guiding members 104, 106 oppositely mounted on said frame 102, a third guiding member 108 slideably mounted on the first and second guiding members, and a hand-gripping member 110 slideably mounted on the third guiding member.

Figure 2:
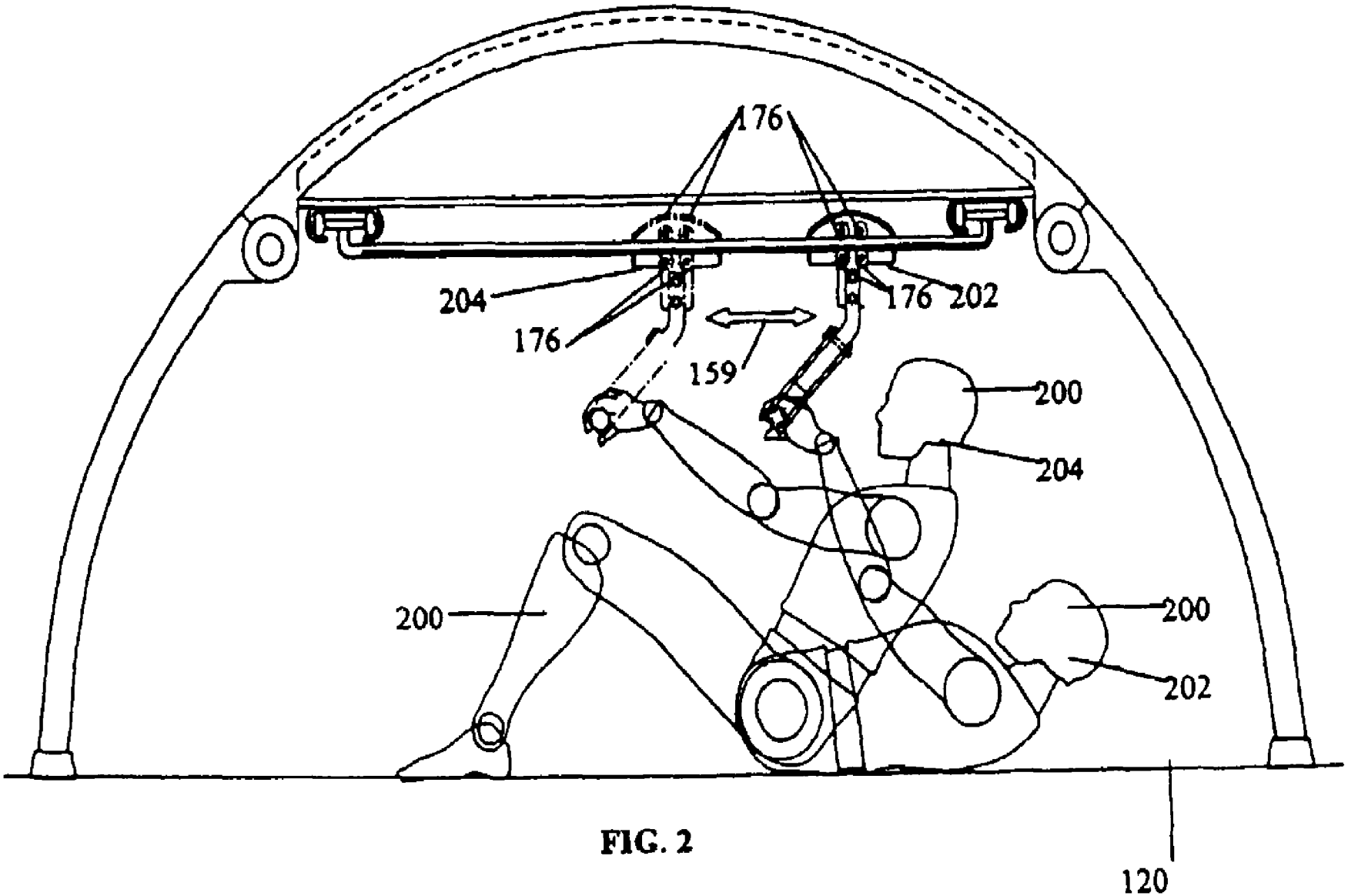
FIG. 2 is a side elevational view of the exercise device of FIG. 1, including a user exercising according to one method of exercise.

The frame 102 functions to provide a mounting for the guiding members and hand-gripping member, such that the hand-gripping member is positioned above the user's head while the device is freestanding on a surface 120. The frame includes support members, 112 and 114, for supporting an oppositely disposed pair of mounting members 116, 118 on which the first and second guiding members 104, 106 are mounted. The support members 112, 114 have leg members, 122, 124, 126, 128, such that the device is freestanding. The leg members 122, 124, 126, 128, may be made foldable, (e.g. via hinge joints, 130, 132, 134, 136, as shown in FIGS. 1 and 2) such that the device can be compacted for easier storage or transportation when not in use. The leg members 122, 124, 126, 128, may further include base elements, 138, 140, 142, and 144, as shown in the Figures.

The frame 102 is preferably metal, but may be made from any suitable rigid material. Although the frame, as illustrated in FIGS. 1 and 2, shows the support members 112, 114 as being arc shape, any suitable design for providing support to the mounting members 116, 118 may be used. For example, the frame may have straight legs extending perpendicularly downwards from the mounting members. Additionally, the mounting members 116, 118 may be secured to the supporting members, and the first and second guiding members may be secured to the mounting members, via any suitable method including bolting, welding, or a wedging or otherwise locking mechanism, or may form an integral unit therewith.

The first and second guiding members 104, 106 provide parallel tracks or rails on which the third guiding member 108 may freely slide side-to-side, as indicated by the arrow 146 in FIG. 1. According to a preferred embodiment, the guiding members 104 and 106 each include brackets 148, 150, and 152, 154, respectively, disposed on a flat surface 156 and 158 of each guiding member for receiving rotating members disposed on the third guiding member 108. Although the brackets 148, 150, and 152, 154 are illustrated in the figures as oriented downwards with respect to the surfaces 156, 158, they may also be configured upwardly. Furthermore, the second guiding member 106 is shown broken in FIG. 1 for the purpose of illustration; however, it is to be understood that the member 106 is an unbroken, continuous piece.

The third guiding member 108 may comprise a bar 158 extending between the first and second guiding members, and rotating members 160, 162 disposed at either end of the bar for sliding along the brackets 148, 150, and 152, 154 of the first and second guiding members 104, 106. The rotating members 160, 162 may each comprise a surface 164 and 166, respectively, and a set of wheels 168 and 170, each set comprising two pairs of wheels, oppositely disposed across the respective surface 164 and 166, for sliding along the brackets 148, 150, and 152, 154 of the respective guiding member 104, 106.

Figure 3:
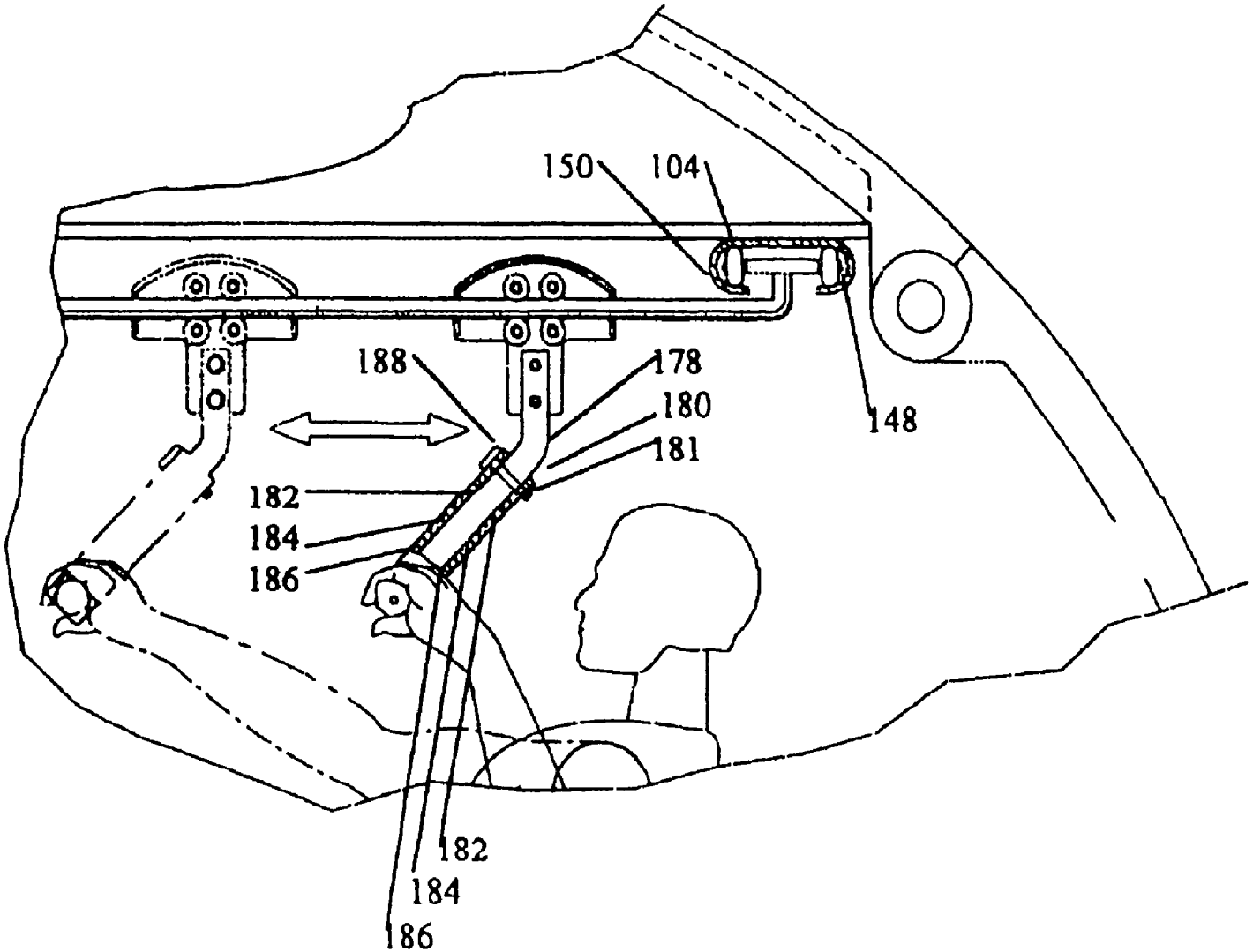
FIG. 3 is an enlarged sectional view of the third guiding member and hand-gripping member of the exercise device of FIG. 1.
Figure 4:
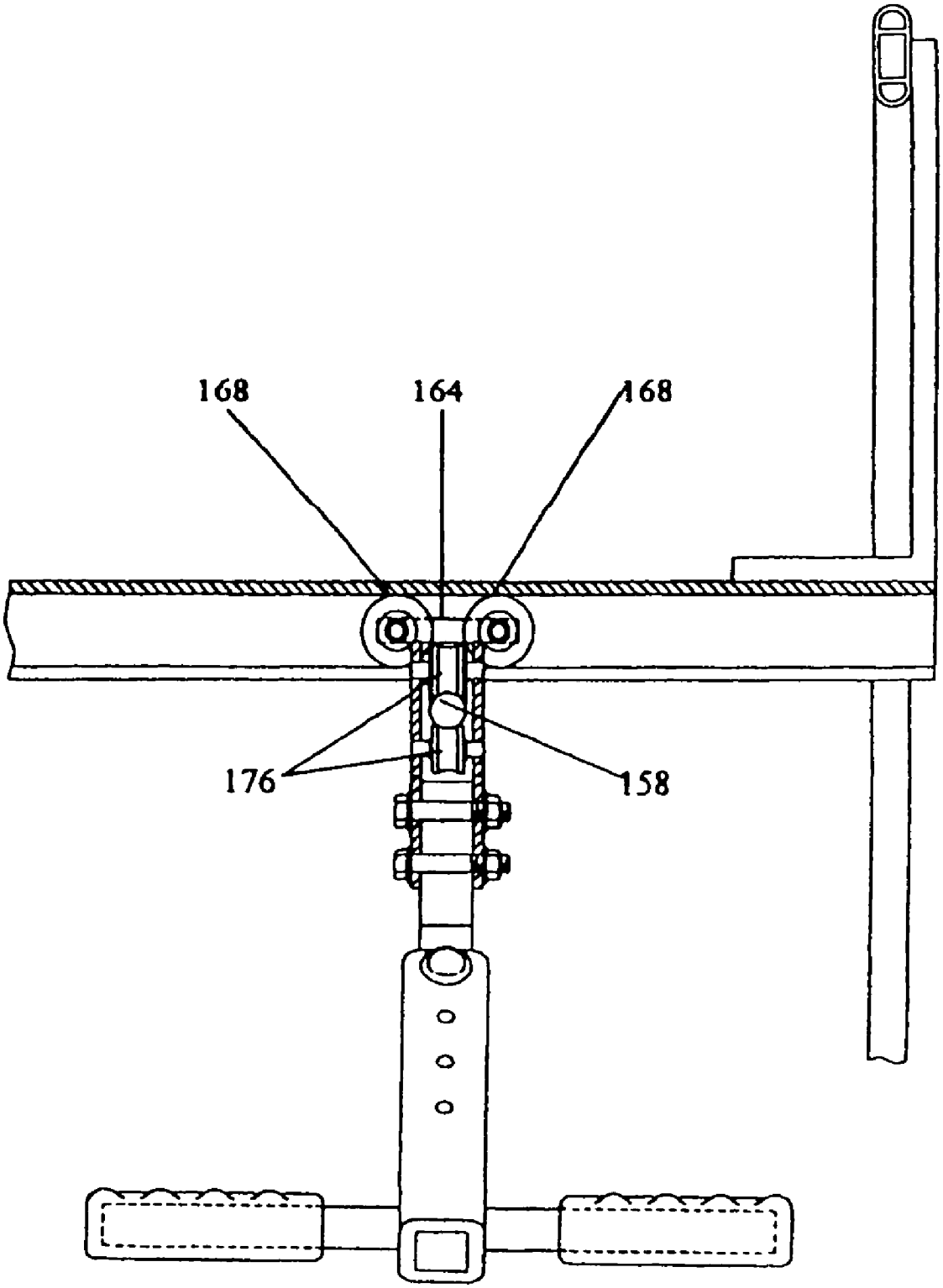
FIG. 4 is a front sectional view of the exercise device of FIG. 1.

The hand-gripping member 110 comprises a slideable member 172 coupled to an element which the user can grip, such as handles 174. As shown in FIGS. 2-4, the slideable member 172 may be made slideable on the bar 158 of the third guiding member 108, via wheels 176, which contact the bar 158 on top and bottom sides of the bar, such that the slideable member can slide front-to-back on the bar 158, as indicated by the arrow 159 in FIG. 1. (Alternate methods for providing slideable elements will be illustrated by alternate embodiments described herein).

As best illustrated in FIG. 3, the slideable member 172 may have a hollowed out portion for coupling the slideable member to the handles, by inserting a narrower connector piece 178 into the hollowed out portion, the hollowed out portion and connector piece having corresponding holes for bolting or screwing the pieces together. Additionally, the distance of the handles 174 from the surface 120 may be made adjustable by providing a hollowed rod 180 extending from the handles and having several locking holes 181, 182, 184, 186 for locking the handles into a corresponding hole of the connector piece via a locking pin 188.

As the hand-gripping member 110 can slide from side-to-side, and from front-to-back, curved or circular motion can be achieved (as indicated by the arrow 190 in FIG. 1), as well as diagonal motion.

FIG. 2 illustrate a user 200 exercising on the device 100 by moving his body from a first position 202, in which the user's upper body is positioned substantially flat against the surface 120, to a second position 204 in which the user's upper body is lifted forwards and up. (The device 100 is preferably smaller in scale with respect to the user's body then what is shown in the figure).

The user's hands extend to grip the handles 174 as the user exercise. The grip handles 174 move from the first position 202 to the second position 204 along with the user 200, such that the user's arms can remain extended at substantially the same length, as the user 200 moves. Thus the user's abdominal region is exercised while the arms can be kept fully extended away from the user's body. The force which the user exerts on the gripping element reduces the strain and pressure on the user's neck and back muscles, thus providing an isolated work out for mainly the abdominal muscles. Additionally, the user is guided through proper and consistent alignment while exercising.

While the user 200 is illustrated in FIG. 2 as moving his upper body in a front-to-back motion, many different exercise techniques are possible. For example, the user can move his raised upper body in a side-to-side motion, front-to-back motion, diagonal motion, or in a circular or semi-circular motion, or in a combination of different motions while keeping the arms fully extended.

An element for providing motion resistance to the hand-gripping member may be included. This may be accomplished by placing a weight on the hand-gripping member, or otherwise providing a friction-bearing element coupled to the hand gripping member, or coupling a spring or rubber band element between the frame and hand-gripping member.

Many different designs for providing a hand-gripping member capable of side-to side, front-to back, and/or rotational motion will be apparent to one skilled in the art. Methods for achieving the desired motion include providing a slideable attachment, spring mounting, pivot or ball attachment, or pendulum attachment coupled between the hand gripping member and frame. The following embodiments will illustrate examples of alternative designs for providing a hand-gripping element capable of the range of motions described herein. It should be understood that the invention is not limited to the examples provided.

Figure 5:
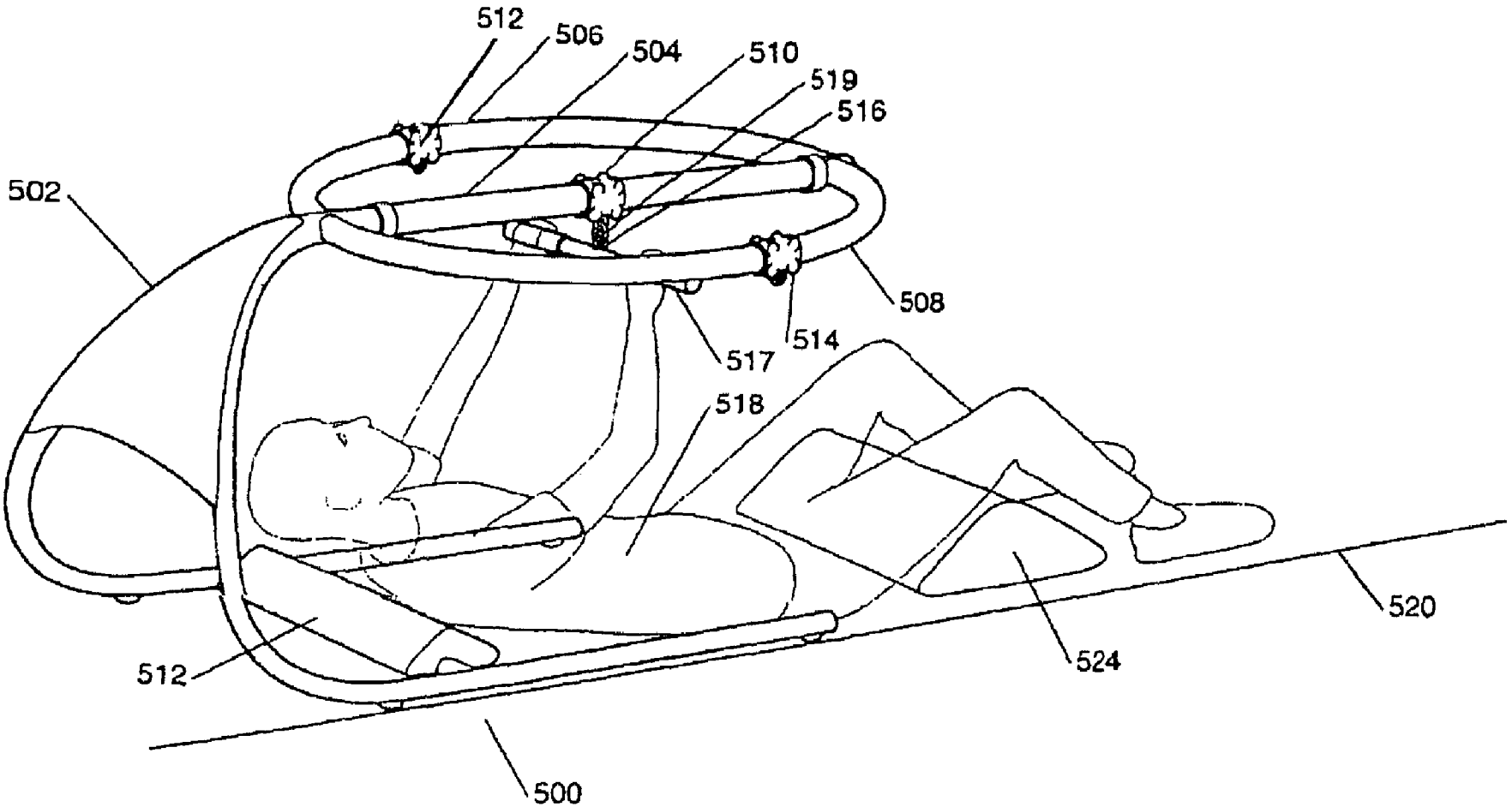
FIG. 5 is a perspective view of an abdominal exercise device according to a second embodiment of the present invention, including a user positioned on the device.

FIG. 5 illustrates an exercise device 500, according to a second embodiment. The device 500 generally comprises a frame 502 supporting guiding members comprising a central guiding member 504, and left and right guiding members 506, 508. The device 500 further comprises slideable members 510, 512, and 514 coupled to the guiding members 504, 506, and 508, respectively, for sliding on the guiding members. A hand-gripping member 516 comprising handles 517 and a chain 519 may be coupled to any one of the slideable members 510, 512, or 514. A hook or any other attachment mechanism can be provided for attaching the chain 519 to the slideable members.

As shown in the figure, the left and right guiding members 506 and 508 may each be semi circular units, forming a continuous circular unit integral with the frame. The central guiding member 504 forms a bar or rod through the center of the circle formed by the left and right guiding members 506, 508.

The slideable members 510, 512, and 514 and guiding members 504, 506, and 508 may each have a smooth surface providing nearly frictionless contact between each guiding member and corresponding slideable member. The surfaces may comprise Teflon, plastic, metal, or other smooth material.

A user 518 of the device 500 is positioned for exercise by lying on a surface 520, with his hands gripping the handles 517 of the hand-gripping member 516. As shown in the figure, cushions for supporting the user on the surface 520 may be provided, including a head cushion 522, which may be coupled to the frame as shown, and a leg cushion 524.

By having the hand-gripping member 516 coupled to the slideable member 510 of the central guiding member 504, the user 518 may exercise his abdominal region using a front-to-back motion, while keeping his hands extended on the handles 517. The user can similarly exercise by moving his upper body in a semi-circular front-to-back motion by having the hand-gripping member 516 coupled to the one of the slideable members of the left or right guiding members 506 or 508.

Having a relatively short chain 519, as illustrated in the figure, effectively confines the available patterns of motion to a two-dimensional plane, substantially parallel to the guiding members 504, 506, 508. By increasing the length of the chain 519, the user can also utilize pendulum motion for other ranges of motion. Such motion may include swing motion which may be side-to-side, front-to-back, diagonal or a combination thereof, or fully circular motion (which is also confined to a plane parallel to the guiding members).

Figure 6:
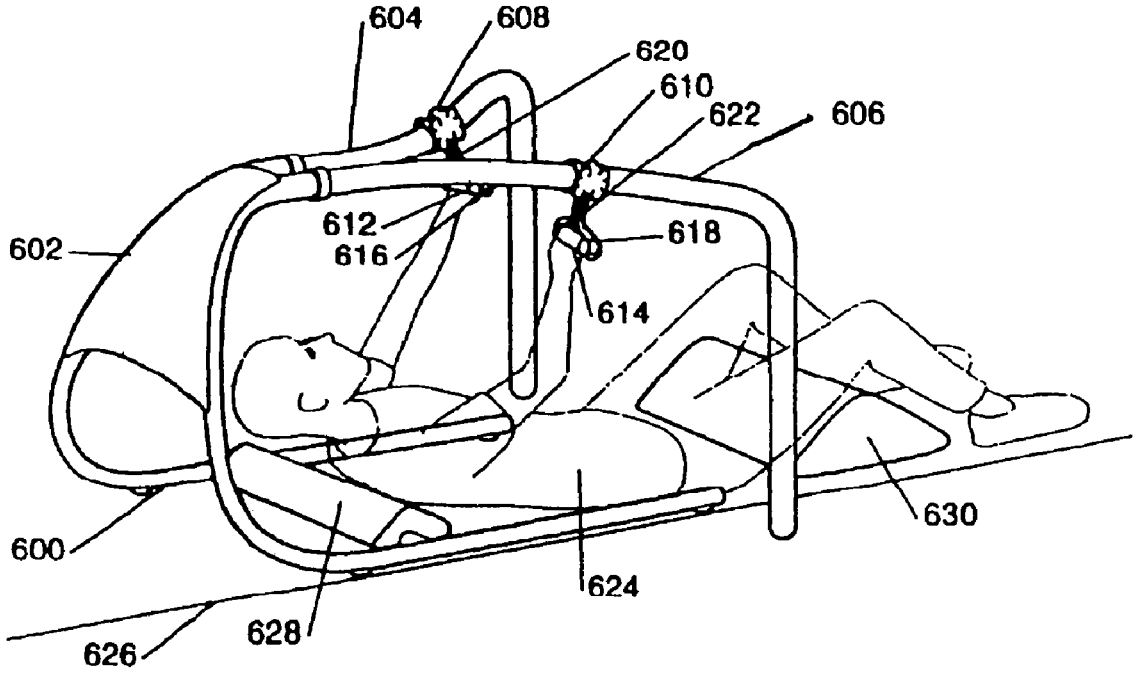
FIG. 6 is a perspective view of an abdominal exercise device according to a third embodiment of the present invention, including a user positioned on the device.

FIG. 6 illustrates an exercise device 600, according to a third embodiment. The device 600 generally comprises a frame 602 supporting left and right guiding members 604, 606. The device 600 further comprises slideable members 608 and 610 coupled to the guiding members 604 and 606, respectively, for sliding on the guiding members. Left and right hand-gripping member 612 and 614 comprising a left and a right handle 616 and 618, and corresponding chains 620 and 622, respectively, may be coupled to the slideable members 608 and 610. A hook or any other attachment mechanism can be provided for attaching the chains 620, 622 to the slideable members.

As shown in the figure, the left and right guiding members 604, 606 together form a "V" shape integral with the frame. Similar to the device 500, the slideable members 608 and 610 and guiding members 604 and 606 may each have a smooth surface providing nearly frictionless contact between each guiding member and corresponding slideable member. The surfaces may comprise Teflon, plastic, metal, or other smooth material.

A user 624 of the device 600 is positioned for exercise by lying on a surface 626, with his left and right hands gripping respective handle 616 and 618. Cushions for supporting the user on the surface 626 may be provided, including a head cushion 628, which may be coupled to the frame as shown, and a leg cushion 630.

The user 624 may exercise his abdominal region using a front-to-back motion, while gripping one of the handles 616, 618 in each hand and tracing along a "V" pattern as the user moves back and forth. A single hand-gripping unit having handles on which the user can grip with both hands can replace either the left or right handle, such that the user can exercise by moving in a left or right front-to-back motion.

Figure 7:
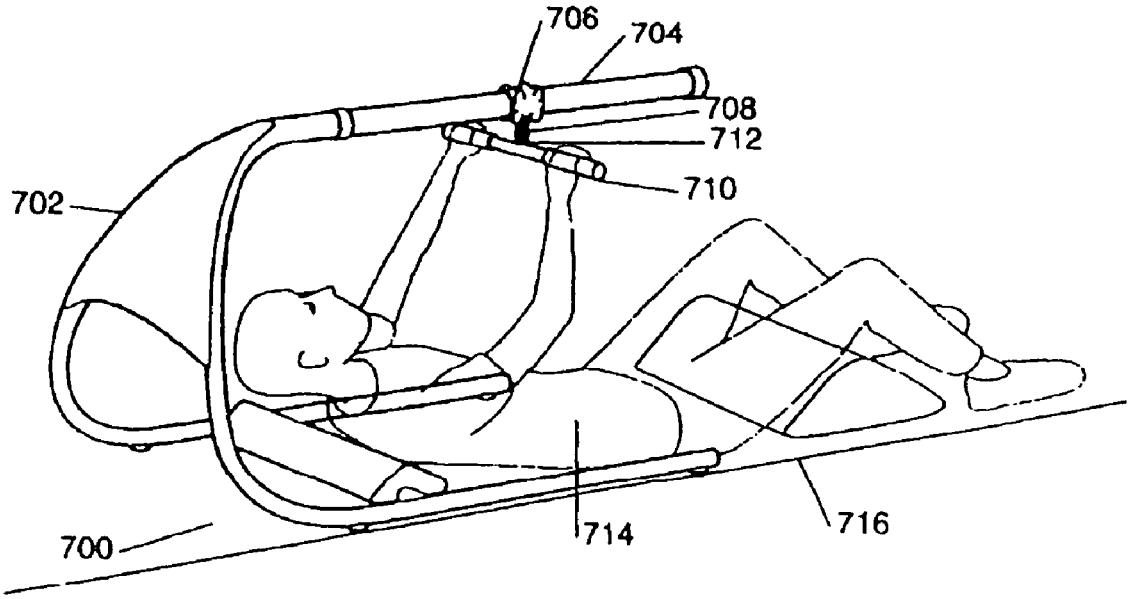
FIG. 7 is a perspective view of an abdominal exercise device according to a forth embodiment of the present invention, including a user positioned on the device.

FIG. 7 illustrates an exercise device 700, according to a forth embodiment. The device 700 generally comprises a frame 702 supporting a centrally extending guiding member 704. The device 700 further comprises a slideable member 706 coupled to the guiding member 704, for sliding on the guiding member. A hand-gripping member 708 comprising handles 710 and a chain 712 may be coupled to the slideable member 706. A hook or any other attachment mechanism can be provided for attaching the chain 712 to the slideable member.

Similar to the devices 500 and 600, the slideable member 706 and guiding member 704 may each have a smooth surface providing nearly frictionless contact between them. The surfaces may comprise Teflon, plastic, metal, or other smooth material.

A user 714 of the device 700 is positioned for exercise by lying on a surface 716, with his hands gripping the handles 710. Cushions for supporting the user on the surface 716 may be provided as shown in the figure. The user 714 may exercise his abdominal region using a front-to-back motion, while gripping the handles 710 to keep his hands fully extended while moving back and forth.

Figure 8:
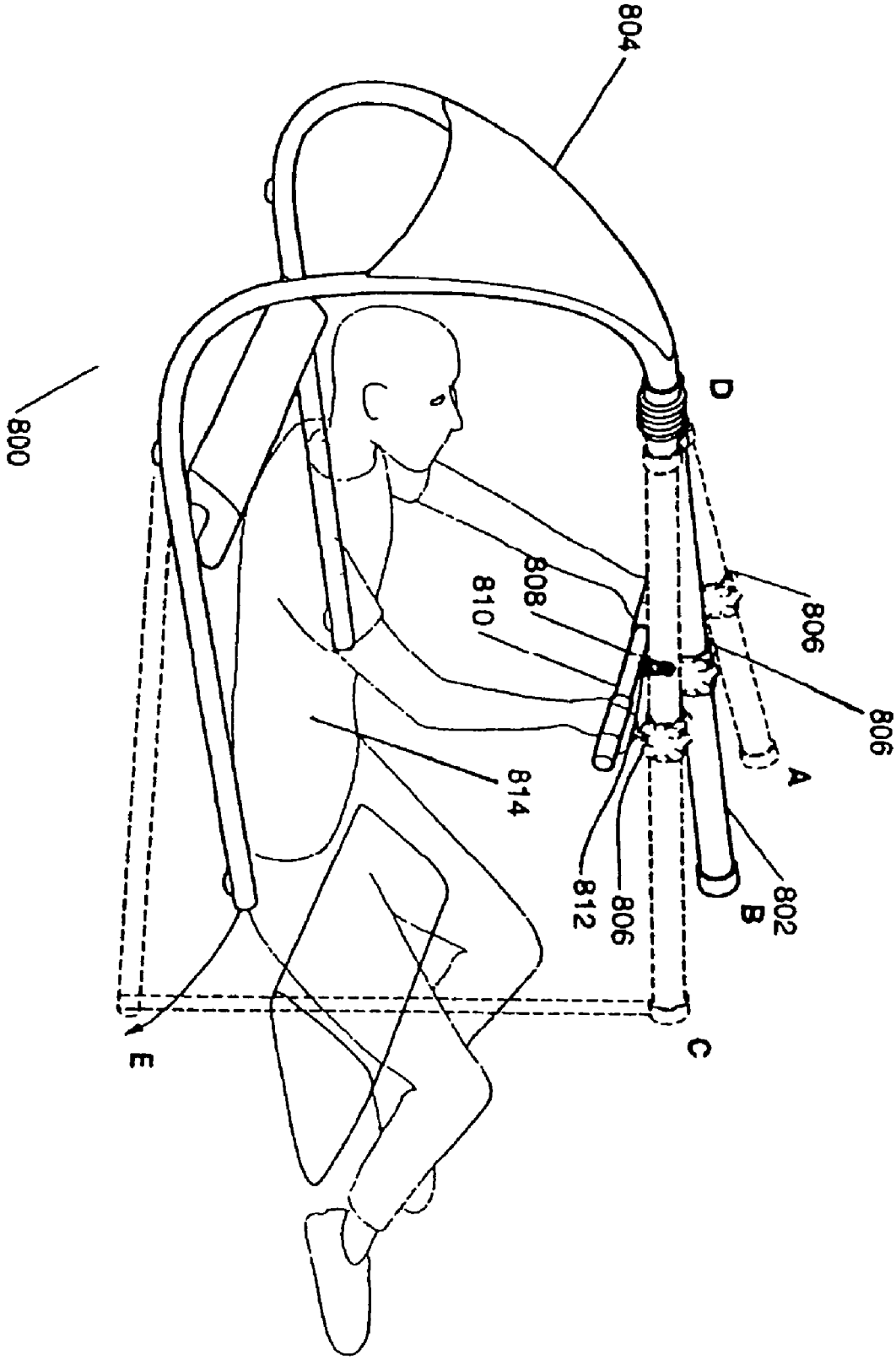
FIG. 8 is a perspective view of an abdominal exercise device according to a fifth embodiment of the present invention, including a user exercising on the device.

FIG. 8 illustrates an exercise devise 800, according to a fifth embodiment. The device 800 is similar to the device 700 of the forth embodiment, except for having a guiding member 802 capable of side-to-side motion via a spring joint mechanism attached to the frame 804, as shown in the figure. (Although not illustrated in the figure, a spring or ball attachment may also be provided for enabling up-and-down and/or rotational movement of the guiding member 802).

As in the device 700, the device 800 also has a slideable member 806 for sliding on the guiding member 802, and a hand-gripping member 808 comprising handles 810 and a chain 812.

A user 814 positioned on the device 800 may exercise his abdominal region using a front-to-back motion, while gripping the handles 810 to keep his hands fully extended while moving back and forth. The user may further cause the guiding member to move side-to-side. Thus, the user can exercise by moving side-to-side, font-to-back, or by combining both side-to-side and front-to-back motion to achieve diagonal, circular, or partially circular motion.

Figure 9:
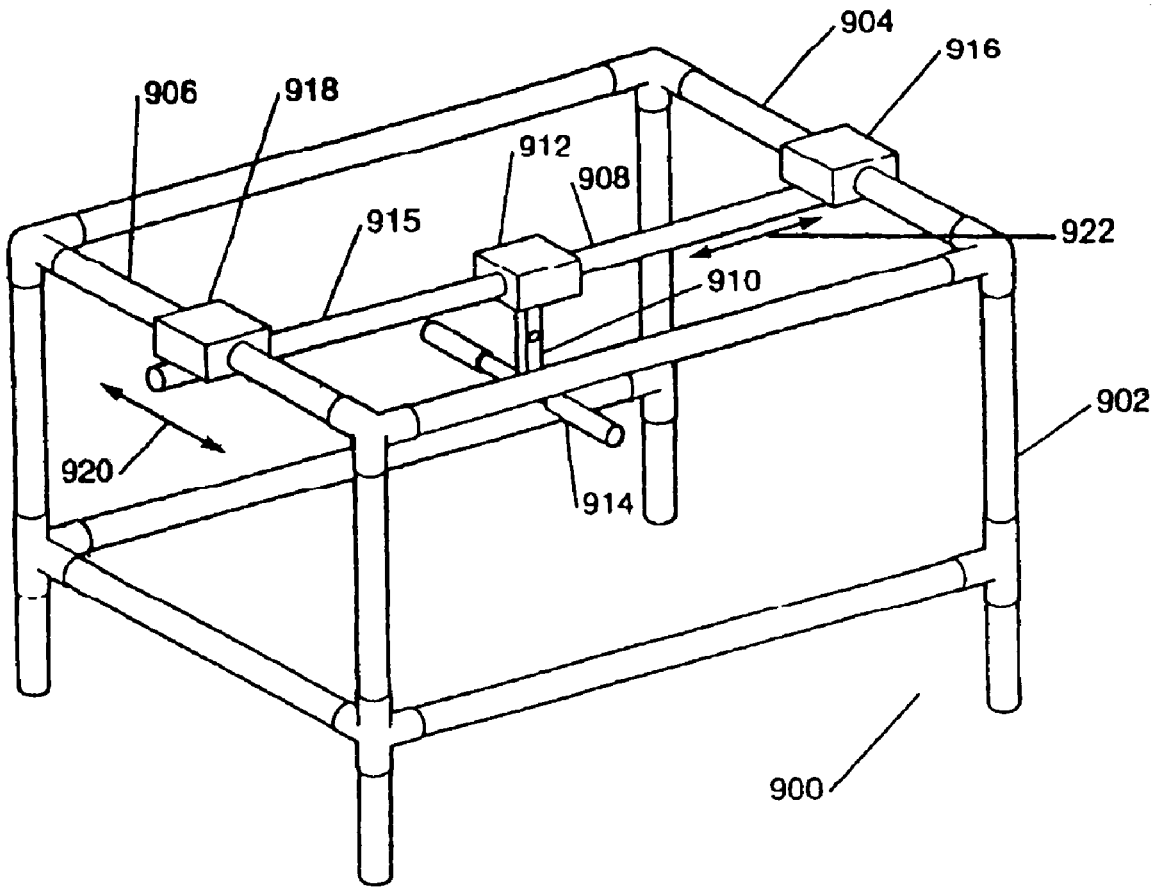
FIG. 9 is a perspective view of an abdominal exercise device according to a sixth embodiment of the present invention.

FIG. 9 illustrates an exercise device 900, according to a sixth embodiment. The device 900 is similar to the device 100 of the first embodiment, in that it generally comprises a frame 902, first and second guiding members 904, 906 oppositely mounted on said frame 902, a third guiding member 908 slideably mounted on the first and second guiding members, and a hand-gripping member 910 slideably mounted on the third guiding member. The hand-gripping member 910 comprises a slideable member 912 and handles 914 which a user can grip.

The first and second guiding members 904, 906 may comprise rails or bars on which the third guiding member 908 may slide. The third guiding member 908 comprises a bar 915 having first and second slideable members 916, 918 on its opposite ends, contacting the first and second guiding members 904, 906, such that the third guiding member 908 may slide from side-to-side, as indicated by the arrow 920.

The slideable members 916, 918 of the third guiding member 908 may be made slideable by providing wheels rotatively guided on the first and second guiding members 904, 906, or by providing smoothly surfaced materials for the slideable members 916, 918 and first and second guiding members 904, 906, such that the slideable members 916, 918, and first and second guiding members 904, 906 are in nearly frictionless contact.

The slideable member 912 of the hand gripping member 910 may similarly be made slideable on the bar 915 of the third guiding member, for moving from front-to-back, as indicated by the arrow 922. Thus, a user can exercise his abdominal region by utilizing front-to-back, side-to-side, diagonal, or circular motion, or a combination thereof, while keeping his arms extended.

Figure 10:
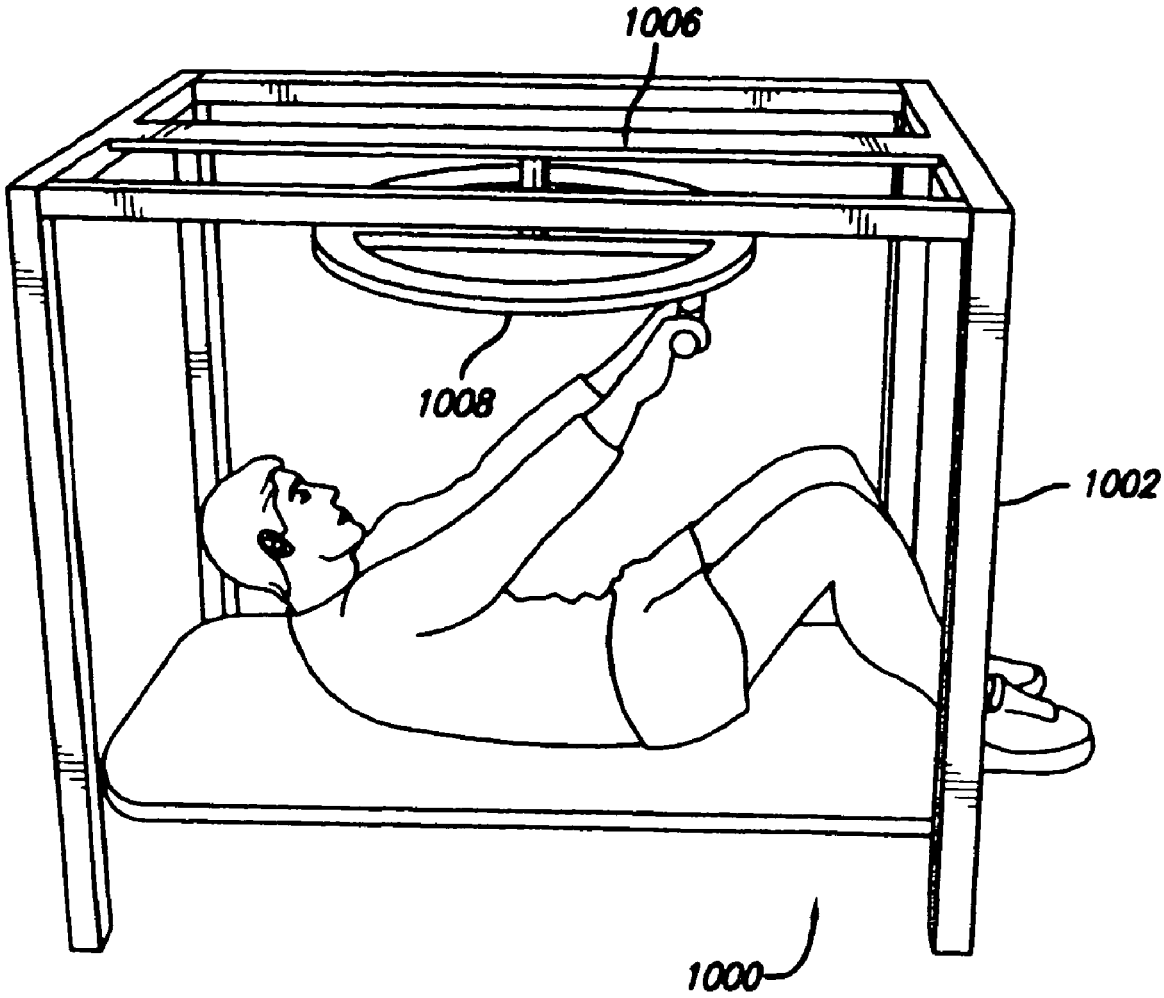
FIG. 10 is a perspective view of an abdominal exercise device according to a seventh embodiment of the present invention, including a user exercising on the device.

FIG. 10 illustrates an exercise device 1000, according to a seventh embodiment, which is similar to the device 500 of the second embodiment, providing an alternate structure for the frame 1002 and circular guiding members 1004, 1006.

Figure 11:
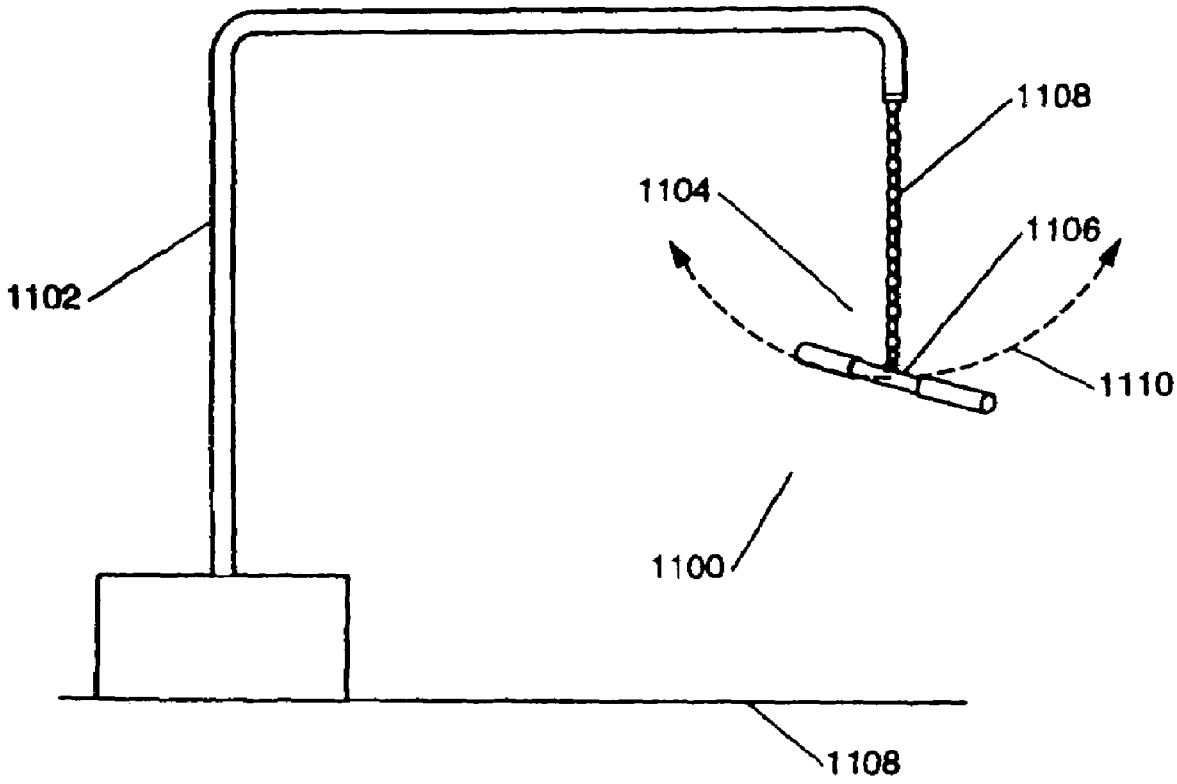
FIG. 11 is a perspective view of an abdominal exercise device according to an eighth embodiment of the present invention.

FIG. 11 illustrates an exercise device 1100, according to an eighth embodiment, comprising a frame 1102 supporting a hand-gripping member 1104 which includes handles 1106 mounted on a long chain 1108. A user can exercise his abdominal region by laying on the surface 1108 with his hands extending to grip the handles 1106, and utilize pendulum or swing motion of the hand gripping member 1104 to move his upper body according to a back-and-forth swing (indicated by the arrow 1110), side-to-side swing, or circular motion.

Figure 12:
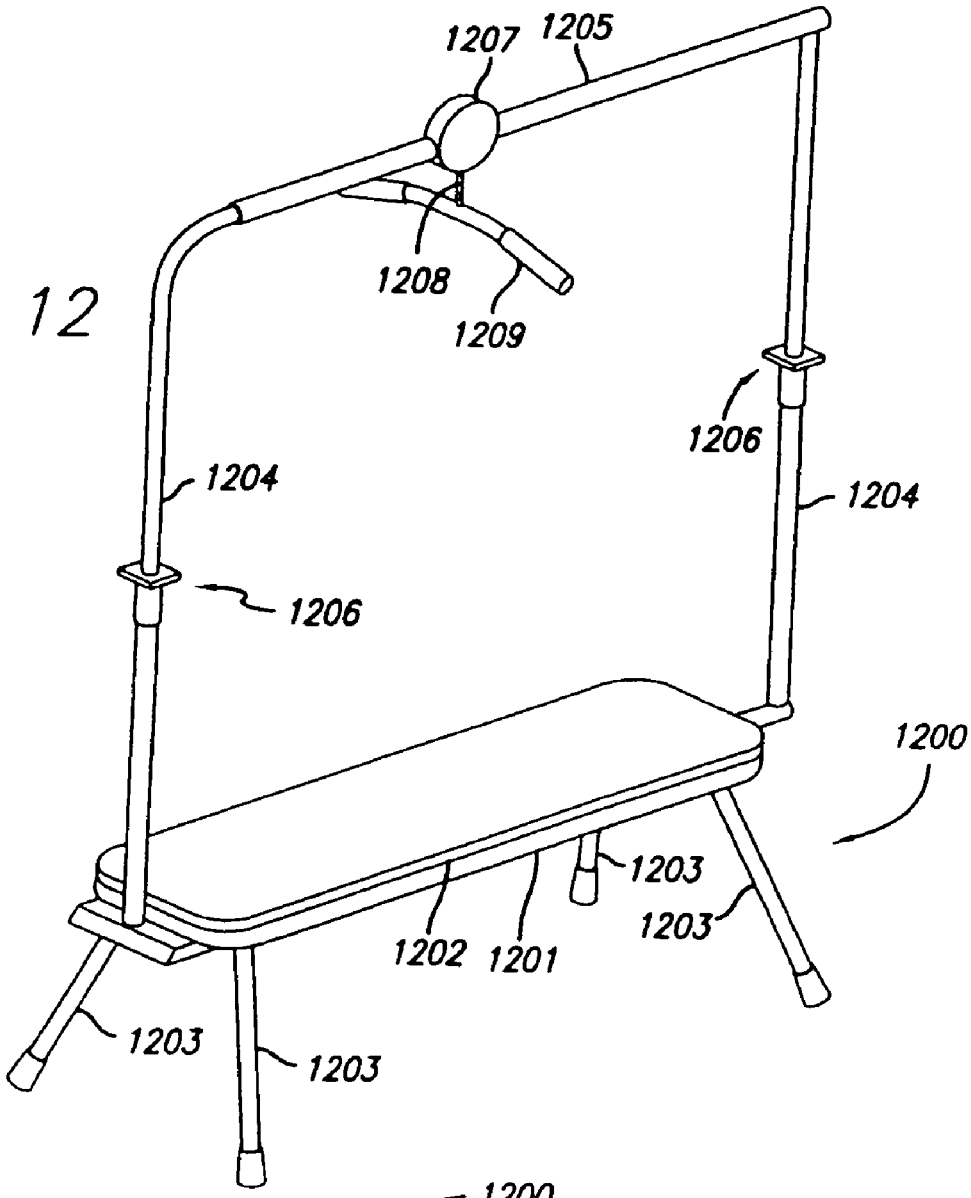
FIG. 12 is a perspective view of an abdominal exercise device according to a ninth embodiment of the present invention.
Figure 13:
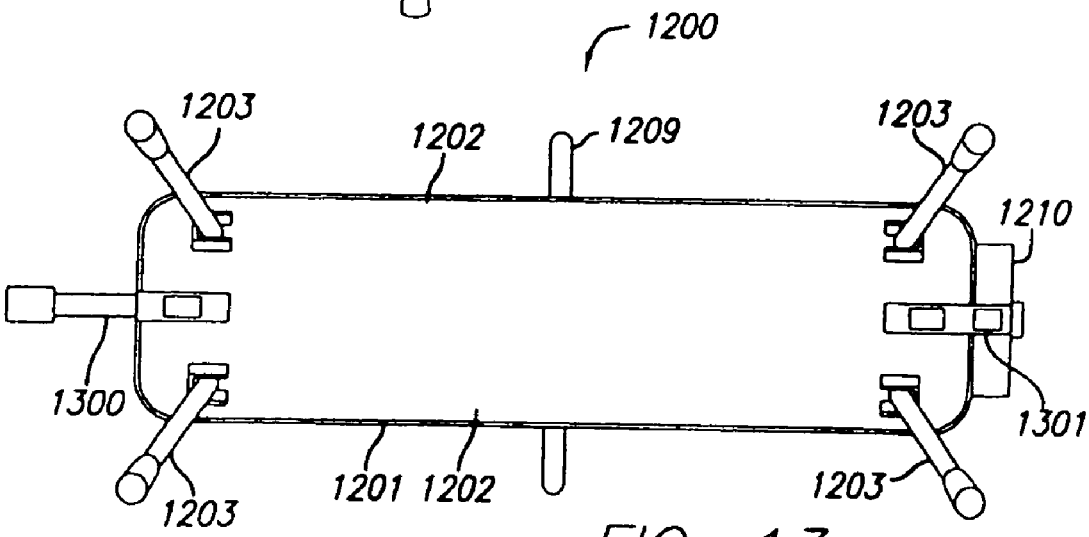
FIG. 13 is a bottom view of the embodiment depicted in FIG. 12.
Figure 14:
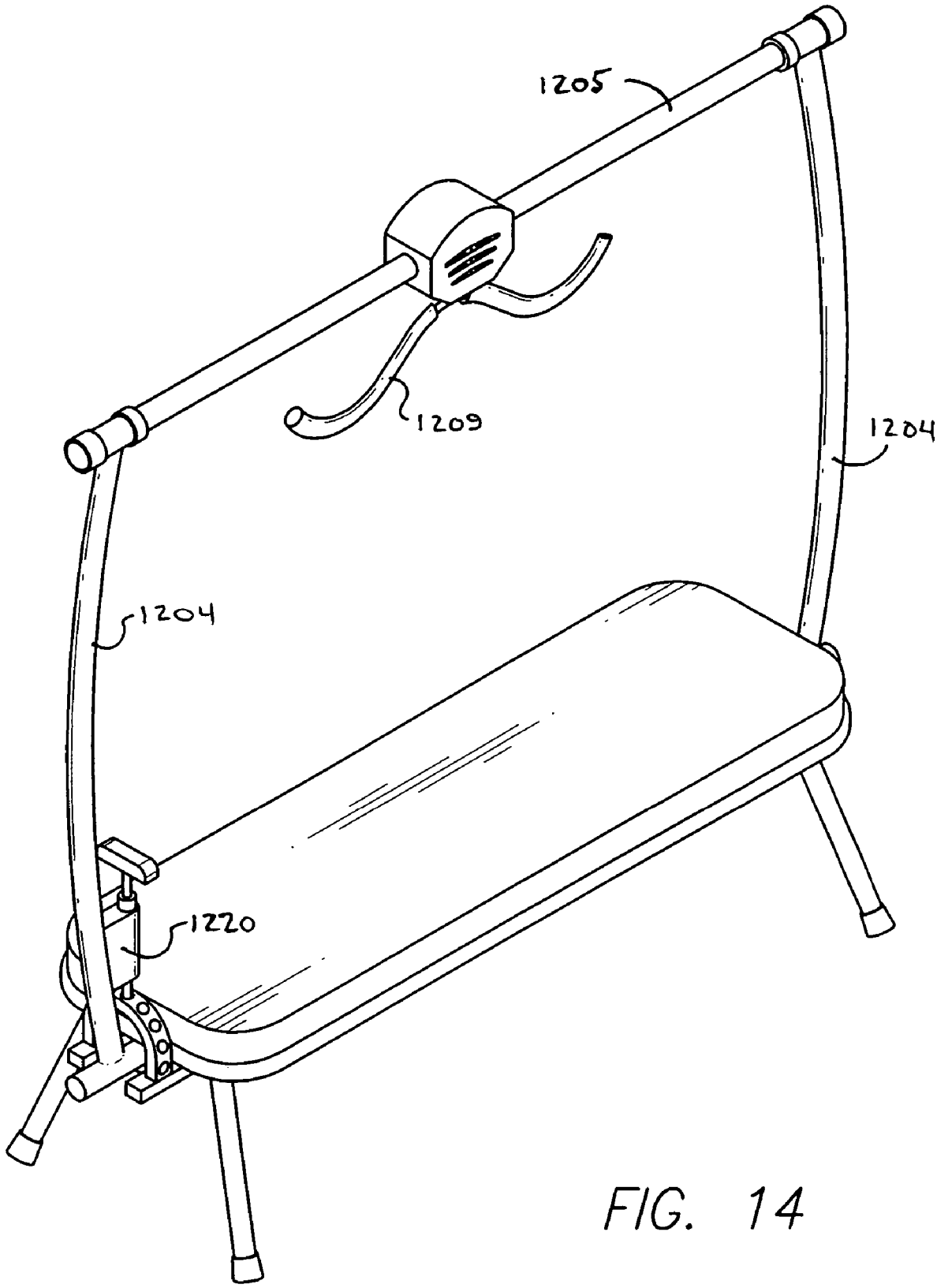
FIG. 14 is a perspective view of another embodiment in keeping with the present invention.

FIG. 12 illustrates an exercise device 1200 according to a ninth embodiment, comprising a bench 1201, a frame 1204, 1205 having a handle 1209 slideably movable along the frame member 1205. The bench is a generally rectangular structure as depicted in FIG. 12, but as those skilled in the art will appreciate, the bench 1201 may have a plurality of shapes known or developed in the art. The bench 1201 may include frame members 1202 that are coupled to the edge of the bench. The bench 1201 may also include a plurality of legs 1203 that are coupled to the bottom of the bench 1201. According to one embodiment, the legs 1203 may be foldable. In another embodiment, the legs may be fixed to the bottom of the bench 1201. As shown in FIG. 12, the legs 1203 are splayed to provide additional stability for the bench 1201. In other embodiments, the legs 1203 may be substantially perpendicular to the surface of the bench 1201. In yet another embodiment of the present invention, the frame is configured to be placed or mounted directly on a floor or other flat surface or on one or more blocks or tables without the need for separate leg members.

The exercise device 1200 also includes a frame that is comprised of a plurality of members 1204, 1205. The members 1204, 1205 form a generally U-shaped structure that is securable to the bench 1201. According to one embodiment, the frame members 1204, 1205 may be individual members that are coupled together. In another embodiment, the frame elements 1204, 1205 may be a unitary structure. As shown in FIG. 12, the frame members 1204, 1205 have a generally circular cross section. In other embodiments, the frame members may have a square or rectangular cross section or other such cross section design for providing a sliding or rolling surface for the exercise movements described herein. The vertical members 1204 may include an adjustment means 1206 that allows the height of the vertical member 1204 to be adjusted. That is, the frame member 1205 may be raised or lowered by manipulating the adjustment means 1206. The frame member 1205 is illustrated as being a horizontal bar that is generally parallel to the surface of the bench 1201. A non-parallel bar, however, is equally contemplated within this invention, which would provide the user with a different "throw" during abdominal exercises. As with the embodiment depicted in FIG. 11, the U-shaped frame may comprise one vertical member 1204 and one horizontal member 1205. In other embodiments, there may be a plurality of vertical members 1204.

The frame member 1205 may include a slideable member 1207 that may move along the length of the horizontal member 1205 by the use of reduced-friction surfaces, by using wheels or bearings, or the like. A hand-gripping member 1209 may be coupled to the slideable member 1207 via a coupling means 1208. According to one embodiment, the coupling means 1208 may be a rope, chain, cable, rod, swivel, or the like. As shown in FIG. 12, the hand-gripping member 1209 may be slightly bent at the ends and includes handgrips that are at the end of the hand-gripping member 1209.

In other embodiments, the hand-gripping member 1209 may be a generally straight rod and may or may not include handgrips.

The U-shaped frame member may be coupled to the bench by a plurality of means. According to one embodiment, the U-shaped member may be directly affixed to the ends of the bench 1201. In other embodiments, the frame may be coupled to the bench 1201 by a bracket 1210. In yet another embodiment, the frame may be coupled to the bench 1201 via a combination of brackets and additional tubing. As shown in FIG. 12, the vertical frame members 1204 are generally perpendicular to the surface of the bench 1201.

Figure 15:
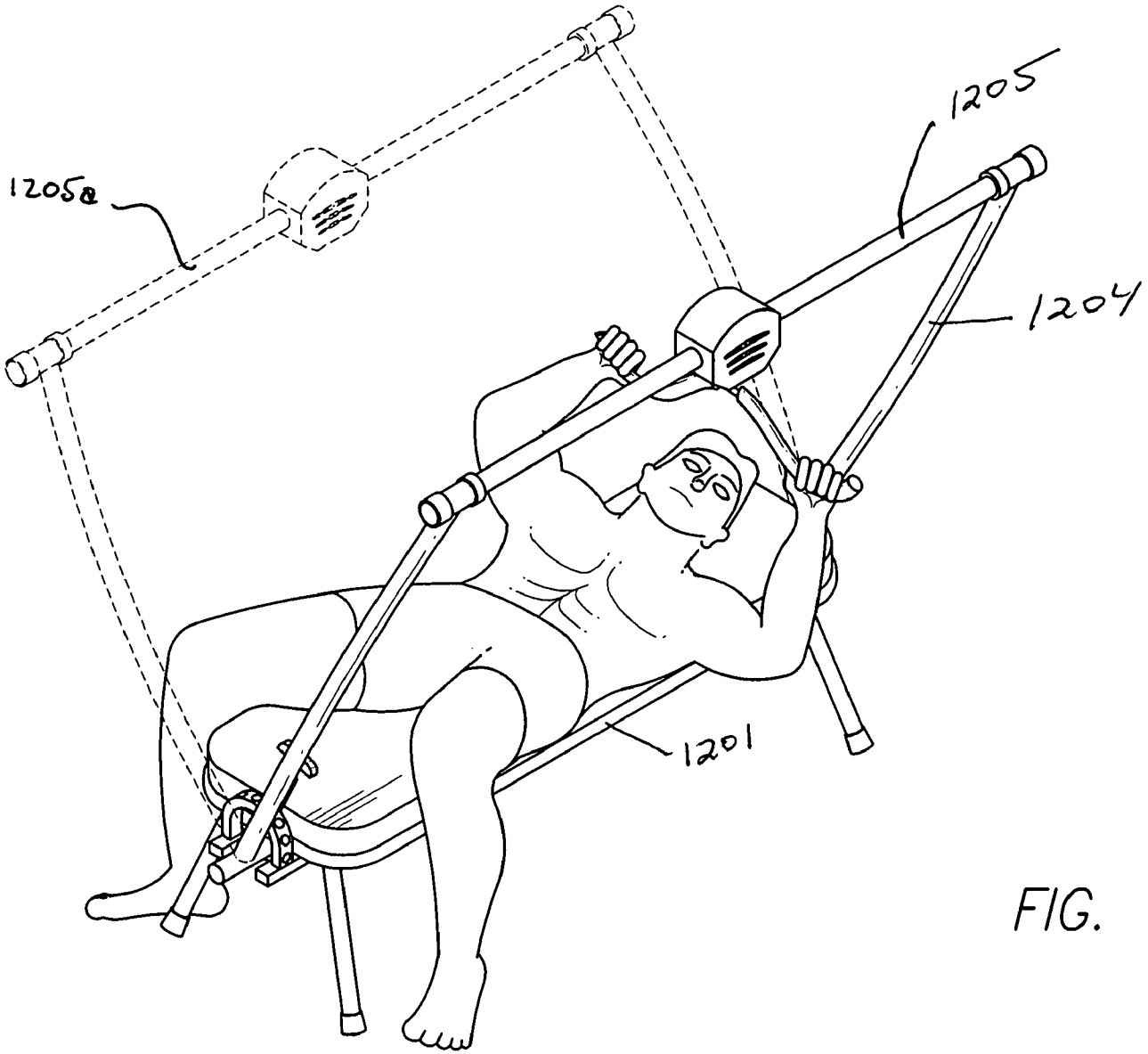
FIG. 15 is a perspective view of the embodiment depicted in FIG. 14, showing a user in a supine position and illustrating the pivoting action of the U-shaped frame member.

In other embodiments, the frame may be pivotally or rotatably coupled to the bench surface such that the frame members 1204, 1205 may be adjusted between an angle of approximately zero degrees to 180 degrees relative to the bench surface. FIGS. 14 through 17 illustrate one such embodiment in which the U-shaped frame member, and thus generally longitudinal frame member 1205, is pivotally attached to a means for supporting a user 1201, such as a bench or a support surface, capable of pivoting about an axis near or below the bottom surface of the bench. To move the U-shaped frame member in such a way, the user would release the locking means or securing means 1220 from an engaged position to a disengaged position before an exercise to allow the U-shaped frame member to pivot about the pivot axis. This pivot axis is shown in FIG. 15, in which the generally longitudinal bar 1205 can be locked at any one of a plurality of angles relative to the support surface 1201 based on the desired exercise such as either the position of bar 1205 or bar 1205*a* in FIG. 15. Alternatively, the exercise itself could involve pivoting the generally longitudinal bar 1205 back and forth between two angles such as the position for bar 1205 and the position shown in dashed lines of bar 1205*a* in FIG. 15.

Figure 17:
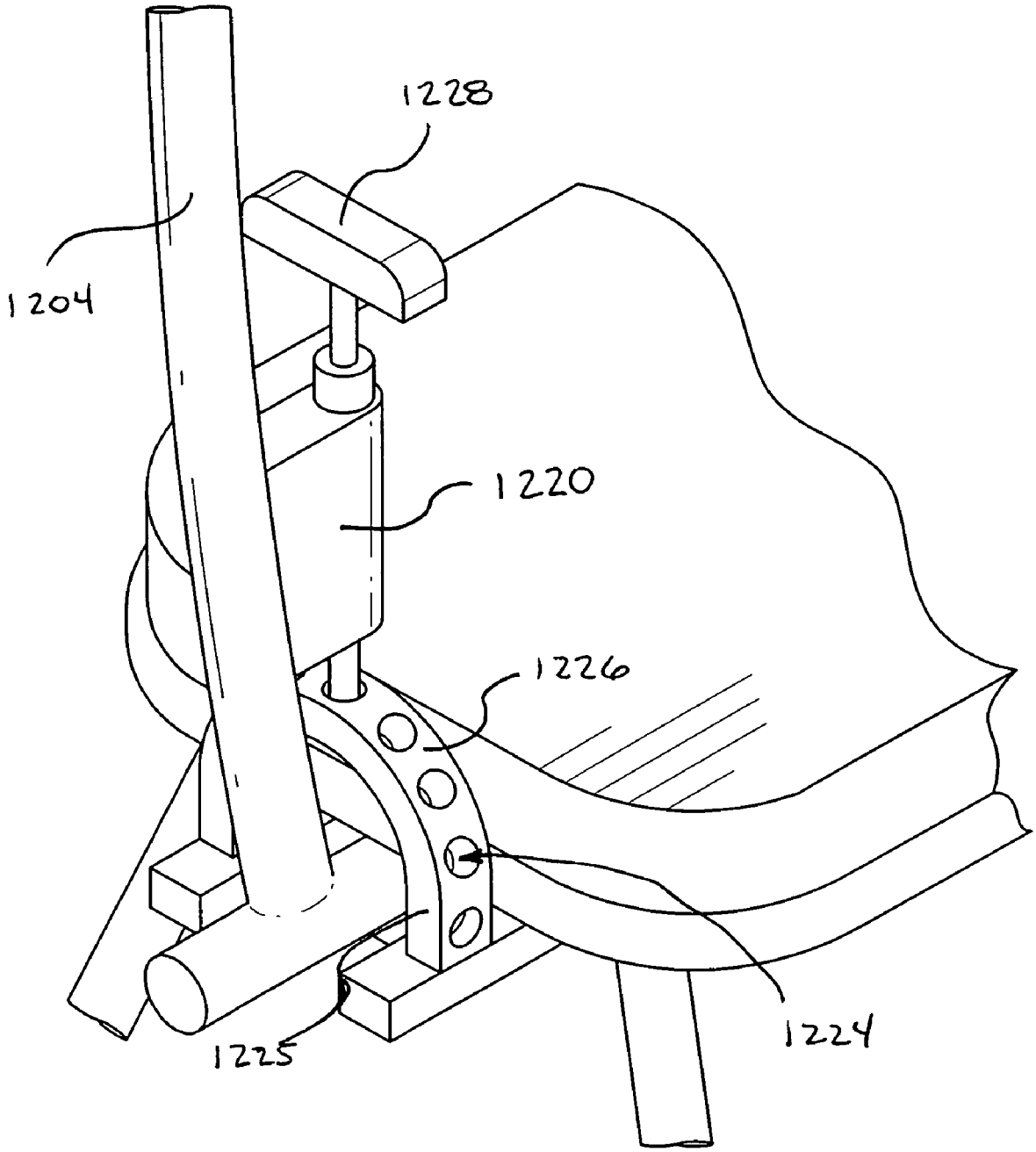
FIG. 17 is a perspective view of an engaging mechanism between the U-shaped frame member and the bench in keeping with the present invention.

Referring to FIG. 17, in some versions the locking means 1220 is a retractable lug member 1222. If the user wants the generally longitudinal bar 1205 to be fixed at an particular angle during the exercise, whether the angle is perpendicular to the bench, parallel to the bench, or any angle in between, the user simply swings the generally longitudinal bar 1205 to the desired angle and moves the lug 1222 into the engaged position by inserting it into one of the plurality of recesses 1224 in engagement surface 1226. That is, the engagement surface 1226 of receptor block or yoke 1225 comprises a plurality of recesses 1224, where each recess is shaped to accept the lug member 1222. In the illustrated embodiment, the lug 1222 is spring activated, and releasing the lever 1228 causes a compression spring (not shown) to force the lug 1222 down towards the engagement surface 1226. Other pin and yoke configurations are equally contemplated, however, within the present invention, including a cog and sprocket arrangement, or alternatively, a threaded pin that requires the user to press the pin into the desired hole, which is tapped with mating threads, and twist the pin into the engaged position in the hole in order to lock the U-shaped frame member into a desired orientation. The pin and yoke combination could also be replaced with a mechanism comprising engaging teeth, such as a pawl and ratchet wheel, or other such clutch mechanism or one or many clamping configurations such as a tightening strap and tactile contact surface, or the like. With such alternatives, the allowable angular positions of the frame member may be discreet positions (such as with a pin and hole combination) or may be continuous (such as with other common clamping configurations).

In another embodiment, the pin and yoke configuration or other clamping mechanism also includes a way to keep the pin from engaging the yoke or keep the mechanism from clamping during an exercise. As a result, the generally longitudinal bar 1205 may be freely pivoted about the pivot axis during an exercise, adding to the diversity of abdominal muscle exercises that can be performed while lying on the bench. For example, the lug 1222 may be removed from the surface 1226 and withheld from engaging any of the recesses 1224 in the surface 1226 either by moving the lug 1222 to a plane offset from the recesses 1224 or by retaining the lug 1222 in the disengaged position so that it is held away from the surface 1226 itself during the exercise.

By operating this embodiment with the pin or lug released from the surface 1226, the user greatly increases the types of exercises available. The user can lay on the bench 1221 and, holding the handle 1209 with arms extended, pivot the U-shaped frame member side to side without sliding the handle 1209 along the generally longitudinal or horizontal member 1205. The user can also add this sliding action (sliding the handle 1209 along the member 1205) to the exercise and thereby trace out many variable paths with his or her extended arms, such as circles, arches, figure eights, "N" and "W" patterns, and the like. The user can focus the exercises on any muscle group with precision, including focusing on the lower obliques evenly or a series of left lower obliques in a row, etc.

Figure 16:
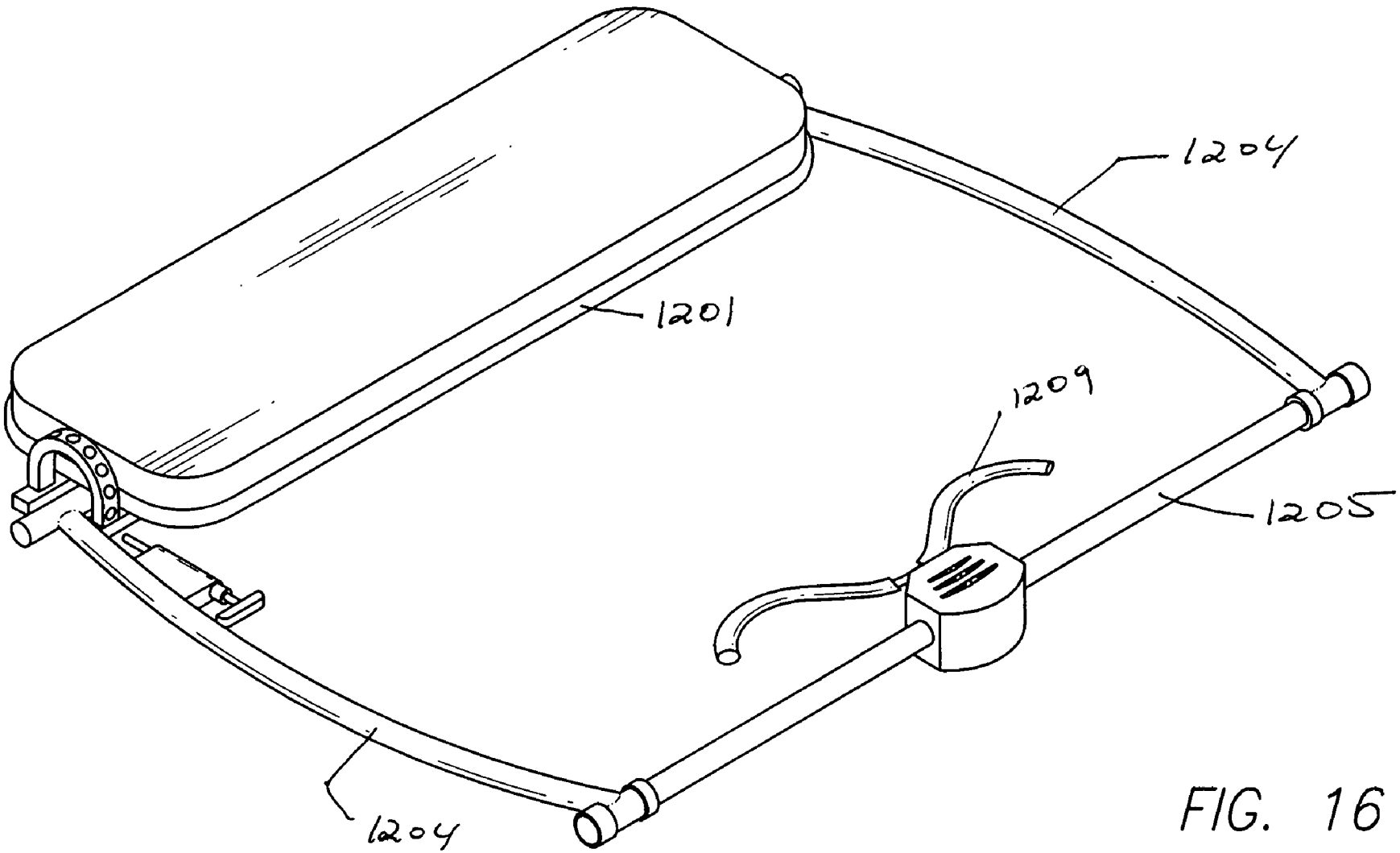
FIG. 16 is a perspective view of the embodiment depicted in FIG. 14 in a folded position for transporting or storing purposes.

Additionally, the pivot action of the entire U-shaped frame member, in combination with the folding legs, permits the entire exercise device to fold down flat as shown in FIG. 16. Since the entire exercise machine can be folded down flat, it may be easily transported and stored under a bed, under a couch, or leaned up against a wall in a closet, or the like. In fact, the dimensions of the device once folded down flat is quite small, limited by only the thickness of the bench and the legs once folded up along the under side of the bench. This thickness preferably is less than four inches and is, more preferably, two to three inches. The key to this convenient, thin profile for moving and storing the device when not in use is that both the handle 1209 and the U-shaped frame member are completely pivotable and foldable with respect to the bench 1201, as well as by the additional fact that the legs are foldable, allowing the entire exercise bench to have exceptional folding and storage characteristics.

In another embodiment, the exercise device may further comprise a means for providing resistance to the pivoting motion of the horizontal member 1205. This resistance means may comprise a frictional element to oppose the pivotal motion of the vertical member 1204. The frictional element may be part of the locking or securing means 1220, or it may be part of the pivotal connection between the vertical member 1204 and the bench 1201. Further, the frictional element may comprise an elastic band connected between the bench 1201 and the vertical member 1204 or any other such device to increase the force required to pivot the vertical member.

While the present invention has been described with regards to particular embodiments, it is recognized that additional variations of the present invention may be devised without departing from the inventive concept.

What is claimed is:

1. An abdominal exercise device comprising:

a support surface, having a first end and a second end, and having a longitudinal axis running from the first end to the second end, the support surface having a topside and an underside;

at least one generally longitudinal bar pivotally connected to said support surface, the pivotal connection defining an axis of rotation generally parallel to and located at or below the longitudinal axis of the support surface;

a handle connected to the generally longitudinal bar, the handle positioned a sufficient distance from the support surface to permit a user to grasp the handle with at least one hand while the user is lying with his or her back on said support surface; and wherein said handle slides along at least a portion of the surface of the longitudinal bar to allow the user to perform abdominal exercises.

2. The exercise device of claim 1 wherein the pivotal connection between the support surface and the generally longitudinal bar further comprises a locking means wherein the generally longitudinal bar is pivoted to and locked at a selected angle from the plane of the support surface before the user performs an exercise.

3. The exercise device of claim 2 wherein the locking means comprises a retractable stop lug and a receptor block.

4. The exercise device of claim 3 wherein the receptor block comprises an arc-shaped outer face and a plurality of recesses along the outer face, wherein each recess is shaped to receive a portion of the stop lug and is positioned in sufficient proximity to the stop lug to allow the stop lug to retractably engage one of the plurality of recesses thereby locking the generally longitudinal bar at an angle determined by the position of the engaged recess and preventing further pivoting thereof until said stop lug is retracted from the recess.

5. The exercise device of claim 1 wherein the pivotal connection between the support surface and the generally longitudinal bar further comprises a means for providing resistance to the pivoting motion of the at least one vertical support bar.

6. The exercise device of claim 1 wherein the pivot connection between the support surface and the generally longitudinal bar is positioned beneath the support surface.

7. The exercise device of claim 1 wherein the support surface comprises a padded bench.

8. The exercise device of claim 1 wherein the handle slides along the outer surface of the generally longitudinal bar using small wheels or bearings.

9. An abdominal exercise device comprising:

a means for supporting a user in a supine position, comprising a support surface, having a first end and a second end, and having a longitudinal axis running from the first end to the second end, the support surface having a topside and an underside;

an at least one vertical support bar having a top end and a bottom end, the bottom end of a first vertical support bar being pivotally connected to the first end of the means for supporting the user, the pivotal connection defining an axis of rotation generally parallel to and located at or below the longitudinal axis;

a transverse bar connected to the top end of the at least one vertical support and being generally parallel to the longitudinal axis; and a handle connected to the transverse bar, the handle being shaped to be grasped by at least one hand of the user, the handle being a sufficient distance from the user to permit the user to grasp the handle with at least one hand while the user is in the supine position;

wherein the at least one vertical support bar having a folded position and an extended position, the extended position being that where the at least one vertical support bar is generally perpendicular to a plane defined by the support surface of the means for support, the folded position being that where the at least one vertical support bar is generally parallel to said plane.

10. The exercise device of claim 9 wherein an overall height of the exercise device does not exceed four inches when it is in a completely folded position.

11. The exercise device of claim 9 wherein the at least one vertical support bar comprises at least two vertical support bars, where a second vertical support bar is pivotally connected to the second end of the means for support.

12. The exercise device of claim 9 wherein at least one of the pivotal connections between the at least one vertical support bar and the means for support further comprises a means for securing the at least one vertical support bar in the folded position.

13. The exercise device of claim 12 where the securing means comprises a locking pin connected to the at least one vertical support bar and an arcuate receptor connected to the means for support, the arcuate receptor comprising an arc-shaped member having an outer radius and at least one recess along the outer radius, where the at least one recess is shaped to accept the locking pin, and the arcuate receptor and the locking pin being in sufficient proximity to permit the locking pin to removably enter the at least one recess of the arcuate, such that the at least one vertical support bar can be secured into a position generally parallel to the plane of the support surface.

14. The exercise device of claim 9 where the axis of rotation is beneath the support surface of the means for support.

15. The exercise device of claim 9 where the pivotal connection is mounted to the underside of the support surface of the means for support.

16. A method of exercising the abdominal muscles of a user comprising:

(a) providing a user support surface, a generally longitudinal bar pivotally connected to said user support surface, a handle slideably connected to the generally longitudinal bar, and a locking mechanism comprising an engagement surface having a plurality of recesses and a retractable lug configured to engaged one or more of said recesses to lock the generally longitudinal bar at a selected angle relative to the plane defined by the support surface;

(b) selecting an angle for a given exercise;

(c) positioning the generally longitudinal bar at the selected angle;

(d) locking the generally longitudinal bar at the selected angle by engaging a portion of said retractable lug with one of said plurality of recesses that corresponds to said selected angle;

(e) lying down with one's back on the support surface in a generally supine position;

(f) grasping of the handle with at least one hand;

(g) sliding the handle along the generally longitudinal bar to crunch the user's abdominal muscles;

(h) returning to the generally supine position; and (i) repeating steps (g) and (h) for a desired number of repetitions.

17. The method of claim 16 further the step of selecting an angle at which to lock the generally longitudinal bar involves selecting an angle from a at least five possible angles between 0° and 180° relative to an axis generally parallel to a longitudinal axis of the user when lying in the generally supine position during an exercise.

18. The method of claim 16 wherein the pivotal connection between the generally longitudinal bar and the support surface is located beneath the support surface.

19. A method of exercising the abdominal muscles of a user comprising:

(a) providing a user support surface, a generally longitudinal bar pivotally connected to said user support surface, a handle slideably connected to the generally longitudinal bar;

(b) lying down with one's back on the support surface;

(c) grasping of the handle with at least one hand;

(d) sliding the handle along the generally longitudinal bar to crunch the user's abdominal muscles and, either sequentially or at the same time, pivoting the generally longitudinal bar relative to an axis of rotation oriented generally parallel to and located at or below a line defined by the length of the user's body during an exercise to effectuate an abdominal crunch;

(e) returning to the generally supine position; and (f) repeating steps (d) and (e) for a desired number of repetitions.

20. The method of claim 19 wherein the pivotal connection between the generally longitudinal bar and the support surface is located beneath the support surface.

21. The method of claim 19 where the axis of rotation is attached to the underside of the support surface of the user support surface.

* * * * *